US010692645B2

(12) United States Patent
Leipold et al.

(10) Patent No.: US 10,692,645 B2
(45) Date of Patent: Jun. 23, 2020

(54) COUPLED INDUCTOR STRUCTURES

(71) Applicant: Qorvo US, Inc., Greensboro, NC (US)

(72) Inventors: Dirk Robert Walter Leipold, San Jose, CA (US); George Maxim, Saratoga, CA (US); Marcus Granger-Jones, Scotts Valley, CA (US); Baker Scott, San Jose, CA (US)

(73) Assignee: Qorvo US, Inc., Greensboro, NC (US)

( * ) Notice: Subject to any disclaimer, the term of this patent is extended or adjusted under 35 U.S.C. 154(b) by 154 days.

(21) Appl. No.: 15/467,936

(22) Filed: Mar. 23, 2017

(65) Prior Publication Data

US 2017/0278623 A1 Sep. 28, 2017

Related U.S. Application Data

(60) Provisional application No. 62/312,013, filed on Mar. 23, 2016.

(51) Int. Cl.
*H01F 27/28* (2006.01)
*H01F 19/04* (2006.01)

(52) U.S. Cl.
CPC ..... *H01F 27/2847* (2013.01); *H01F 19/04* (2013.01); *H01F 2027/2861* (2013.01)

(58) Field of Classification Search
CPC ..... H01F 27/29; H01F 2027/2809; H01F 27/2804
USPC ..... 336/200, 232
See application file for complete search history.

(56) References Cited

U.S. PATENT DOCUMENTS

| | | | | |
|---|---|---|---|---|
| 3,465,431 | A | 9/1969 | Henning | |
| 3,491,318 | A | 1/1970 | Henning et al. | |
| 5,517,083 | A | 5/1996 | Whitlock | |
| 6,031,445 | A * | 2/2000 | Marty | H01F 27/2804 257/E21.022 |
| 8,519,814 | B2 * | 8/2013 | Feng | H01F 29/02 336/140 |
| 8,803,648 | B2 * | 8/2014 | Lo | H01F 27/2804 336/182 |
| 9,698,751 | B2 | 7/2017 | Leipold et al. | |
| 2004/0212038 | A1 * | 10/2004 | Ott | H01F 17/0033 257/531 |

(Continued)

FOREIGN PATENT DOCUMENTS

| | | | |
|---|---|---|---|
| JP | 05243057 | A * | 9/1993 |
| KR | 20110114238 | A * | 10/2011 |

OTHER PUBLICATIONS

Non-Final Office Action for U.S. Appl. No. 14/450,156, dated Mar. 14, 2016, 11 pages.

(Continued)

*Primary Examiner* — Tszfung J Chan
(74) *Attorney, Agent, or Firm* — Withrow & Terranova, P.L.L.C.

(57) ABSTRACT

A coupled inductor structure includes a first three-dimensional inductor structure and a second three-dimensional folded inductor structure. At least a portion of the first three-dimensional folded inductor structure is located within a volume bounded by the second three-dimensional folded inductor structure. By nesting the first three-dimensional folded inductor structure within the second three-dimensional folded inductor structure, a variety of coupling factors can be achieved while minimizing the size of the coupled inductor structure.

21 Claims, 10 Drawing Sheets

(56) References Cited

U.S. PATENT DOCUMENTS

| | | | | |
|---|---|---|---|---|
| 2006/0033602 | A1* | 2/2006 | Mattsson | H01F 17/0006 336/200 |
| 2008/0297299 | A1 | 12/2008 | Yun et al. | |
| 2009/0058589 | A1 | 3/2009 | Chen et al. | |
| 2009/0261936 | A1 | 10/2009 | Widjaja et al. | |
| 2011/0241163 | A1* | 10/2011 | Liu | H01L 23/5223 257/531 |
| 2013/0143381 | A1 | 6/2013 | Kikukawa | |
| 2013/0187743 | A1* | 7/2013 | Chang | H01F 17/0013 336/200 |
| 2014/0323046 | A1 | 10/2014 | Asai et al. | |
| 2015/0035625 | A1* | 2/2015 | Ohtomo | H01L 23/5227 333/213 |
| 2015/0035637 | A1 | 2/2015 | Maxim et al. | |
| 2015/0061680 | A1 | 3/2015 | Leskowitz | |
| 2015/0102887 | A1 | 4/2015 | Park | |
| 2015/0116950 | A1 | 4/2015 | Yoo et al. | |
| 2015/0279921 | A1* | 10/2015 | Lam | H01L 28/10 257/531 |
| 2016/0126613 | A1 | 5/2016 | Leipold et al. | |
| 2016/0126623 | A1 | 5/2016 | Maxim et al. | |

OTHER PUBLICATIONS

Non-Final Office Action for U.S. Appl. No. 14/450,156, dated Sep. 15, 2016, 11 pages.
Final Office Action for U.S. Appl. No. 14/450,156, dated Apr. 27, 2017, 12 pages.
Notice of Allowance for U.S. Appl. No. 14/450,156, dated Oct. 11, 2017, 10 pages.
Non-Final Office Action for U.S. Appl. No. 15/717,525, dated Mar. 4, 2019, 10 pages.

* cited by examiner

COUPLED INDUCTOR STRUCTURES

RELATED APPLICATIONS

This application claims the benefit of provisional patent application Ser. No. 62/312,013, filed Mar. 23, 2016, the disclosure of which is hereby incorporated herein by reference in its entirety.

FIELD OF THE DISCLOSURE

The present disclosure relates to structures for inductors, and in particular to structures for two or more coupled inductors.

BACKGROUND

Modern wireless communications standards such as those for Long Term Evolution (LTE) and LTE advanced dictate how signals should be transmitted and received from a wireless communications device. In doing so, these standards place a number of requirements on a wireless communications device, such as output power requirements, spectral masking requirements, and filtering requirements for receive signals that in turn dictate the physical structure of the device. As wireless communications standards continue to advance, these requirements grow in size and complexity. For example, due to the increasing number of bands supported by modern wireless communications standards along with the use of carrier aggregation and multiple-input-multiple-output (MIMO), a wireless communications device must include filters that have both high selectivity and high bandwidth. Often, these requirements are difficult to achieve without significantly increasing the size, cost, and complexity of the wireless communications device.

To address the stringent filtering requirements imposed by modern wireless communications standards, acoustic filters have been increasingly used. While acoustic filters often outperform their lumped element counterparts in terms of selectivity and quality factor, the bandwidth of acoustic filters is highly limited due to the relatively low electromechanical coupling that is physically achievable. Accordingly, lumped element filters are still required for high bandwidth applications.

For purposes of illustration, FIG. 1 is a functional schematic showing a conventional lumped element diplexer 10. The conventional diplexer 10 includes a first port 12, a second port 14, and a third port 16. A first capacitor $C_1$ is coupled in series between the first port 12 and the second port 14. A second capacitor $C_2$ is coupled in series between the first port 12 and the third port 16. A first resonator $R_1$ is coupled in series with a third capacitor $C_3$ between the first port 12 and ground. The first resonator $R_1$ includes a first resonator capacitor $C_{R1}$ coupled in parallel with a first resonator inductor $L_{R1}$ between the third capacitor $C_3$ and ground. A second resonator $R_2$ is coupled in series with a fourth capacitor $C_4$ between the second port 14 and ground such that the first capacitor $C_1$ is coupled between the first resonator $R_1$ and the second resonator $R_2$. The second resonator $R_2$ includes a second resonator capacitor $C_{R2}$ coupled in parallel with a second resonator inductor $L_{R2}$ between the fourth capacitor $C_4$ and ground. A third resonator $R_3$ is coupled in series with a fifth capacitor $C_5$ between the first port 12 and ground, such that the third resonator $R_3$ is in parallel with the first resonator $R_1$. The third resonator $R_3$ includes a third resonator capacitor $C_{R3}$ coupled in parallel with a third resonator inductor $L_{R3}$ between the fifth capacitor $C_5$ and ground. A fourth resonator $R_4$ is coupled in series with a sixth capacitor $C_6$ between the third port 16 and ground such that the second capacitor $C_2$ is coupled between the third resonator $R_3$ and the fourth resonator $R_4$. The fourth resonator $R_4$ includes a fourth resonator capacitor $C_{R4}$ coupled in parallel with a fourth resonator inductor $L_{R4}$ between the sixth capacitor $C_6$ and ground.

While only two resonators are shown in each signal path for purposes of illustration, conventional designs have included any number of resonators to provide a desired filter response. To achieve one or more desired performance characteristics (e.g., quality factor, bandwidth, selectivity), it is often desirable to provide coupling (i.e., inductive coupling or mutual inductance) between various ones of the first resonator inductor $L_{R1}$, the second resonator inductor $L_{R2}$, the third resonator inductor $L_{R3}$, and the fourth resonator inductor $L_{R4}$. Said coupling may be used to obtain a desired bandwidth of the conventional diplexer 10, provide cancellation of signals between signal paths, or otherwise tune the operation of the diplexer. Coupling is expressed by a coupling factor k, also known as a coupling coefficient, which is a value between negative one and one ($-1 \leq k < 1$) representing both the magnitude and direction of the coupling. The desired level of coupling varies between the different resonator inductors $L_R$. For example, it may be desirable to provide high coupling between some of the resonator inductors $L_R$ such that a coupling factor between the resonator inductors $L_R$ is greater than 0.4, provide moderate coupling between some of the resonator inductors $L_R$ such that a coupling factor between the resonator inductors $L_R$ is between 0.1 and 0.4, and provide low or no coupling between other ones of the resonator inductors $L_R$ such that a coupling factor between the resonator inductors $L_R$ is less than 0.1.

Using conventional inductor structures such as planar inductors and "figure 8" inductors, the aforementioned desired coupling factors between resonator inductors $L_R$ are very difficult to achieve. This is due to the fact that conventional inductor structures provide a relatively large magnetic field perpendicular to a plane on which other inductor structures are located with little to no cancellation thereof. Accordingly, coupling between nearby conventional inductor structures is largely dictated by the space between them, often requiring very large distances between inductor structures to obtain moderate, low, or no electromagnetic coupling. This is often impractical or impossible in wireless communications devices where space is highly limited. Further, the performance (e.g., quality factor) of conventional inductor structures is often quite low, making them unsuitable for many applications such as the stringent filtering discussed above.

In light of the above, there is a need for improved inductor structures for providing coupled inductors with desired coupling factors in a minimal form factor and with high performance.

SUMMARY

In one embodiment, a coupled inductor structure includes a first three-dimensional folded inductor structure and a second three-dimensional folded inductor structure. The first three-dimensional folded inductor structure and the second three-dimensional folded inductor structure each include a first column, a second column, a third column, and a fourth column, each of which is perpendicular to and runs between a first plane and a second plane. A first terminal plate and a second terminal plate are in the first plane. The first terminal plate is coupled to the first column and the second terminal is coupled to the second column. A first connector plate is in the second plane and runs between the first column and the second column. A second connector plate is in the first plane and runs between the second column and the third column. A third connector plate is in the second plane and runs between the third column and the fourth column. At least a portion of the first three-dimensional folded inductor structure is located within a volume bounded by the second three-dimensional folded inductor structure. By using three-dimensional folded inductor structures and nesting at least a portion of the first three-dimensional folded inductor structure within the volume bounded by the second three-dimensional folded inductor structure, a quality factor of each one of the three-dimensional folded inductor structures may be increased and a variety of coupling factors between the first three-dimensional folded inductor structure and the second three-dimensional folded inductor structure may be achieved while minimizing the volume of the coupled inductor structure.

In one embodiment, at least a portion of the second three-dimensional folded inductor structure may be located within the volume bounded by a third three-dimensional folded inductor structure.

In one embodiment, a coupled inductor structure includes a plurality of three-dimensional folded inductor structures such that a coupling factor between a first pair of the plurality of three-dimensional folded inductor structures is less than 0.05, a coupling factor between a second pair of the plurality of three-dimensional folded inductor structures is greater than 0.3, and a total volume of the coupled inductor structure is less than 0.5 $mm^3$. Providing the various coupling factors between different pairs of three-dimensional folded inductor structures in the coupled inductor structure while maintaining a low volume may allow for the creation of a compact and high performance filter.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
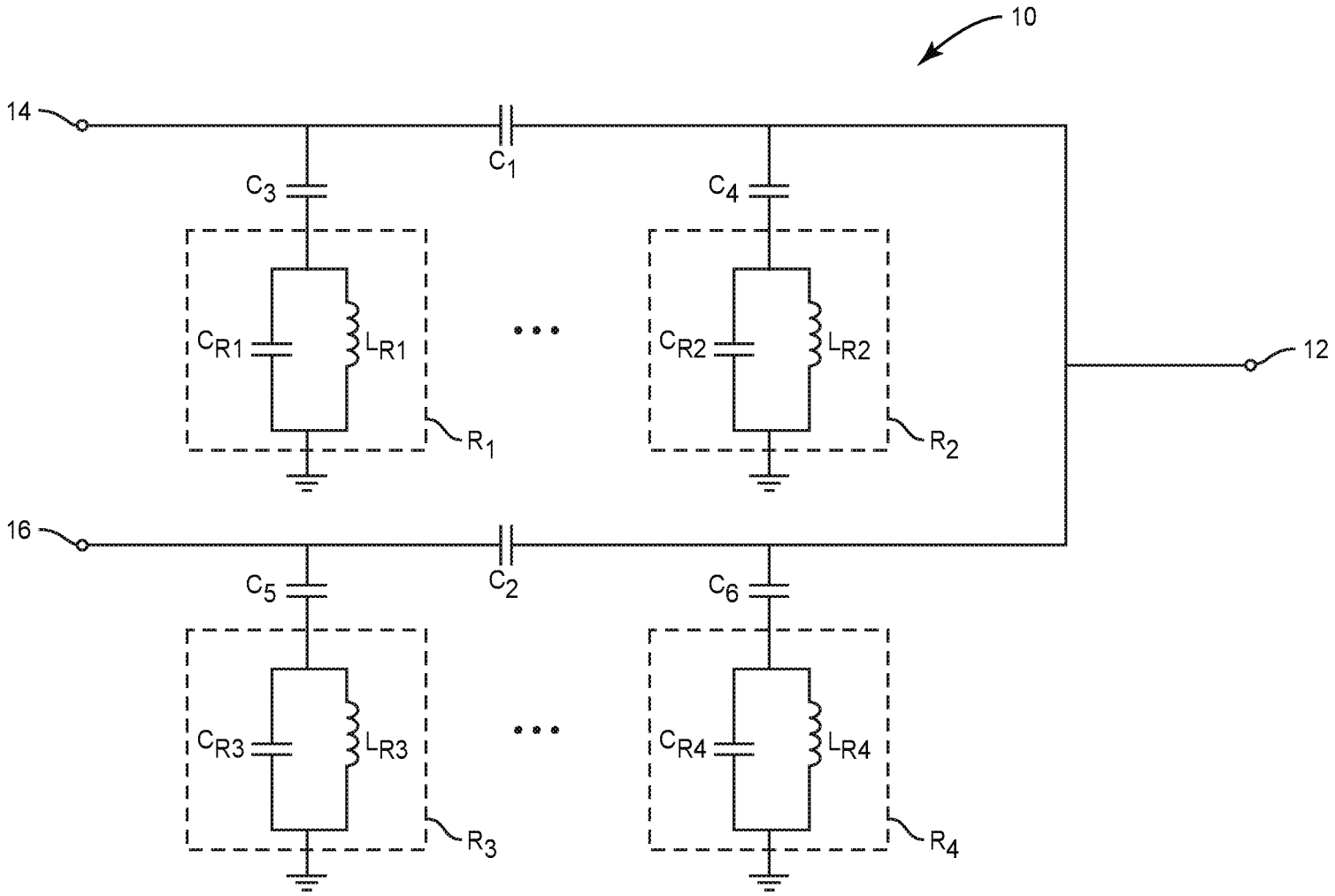
FIG. 1 (RELATED ART)
FIG. 1 is a functional schematic illustrating a conventional diplexer.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 2B:
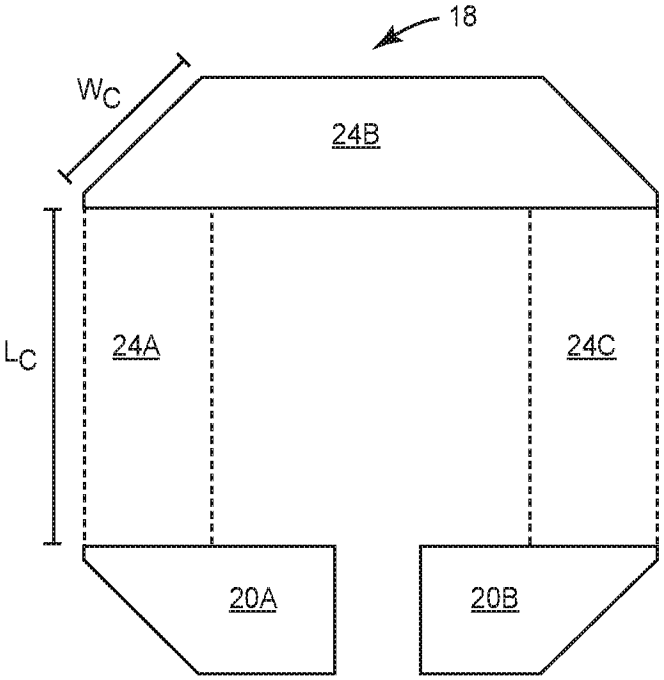
FIGS. 2A and 2B illustrate a three-dimensional folded inductor structure according to one embodiment of the present disclosure.
Figure 2A:
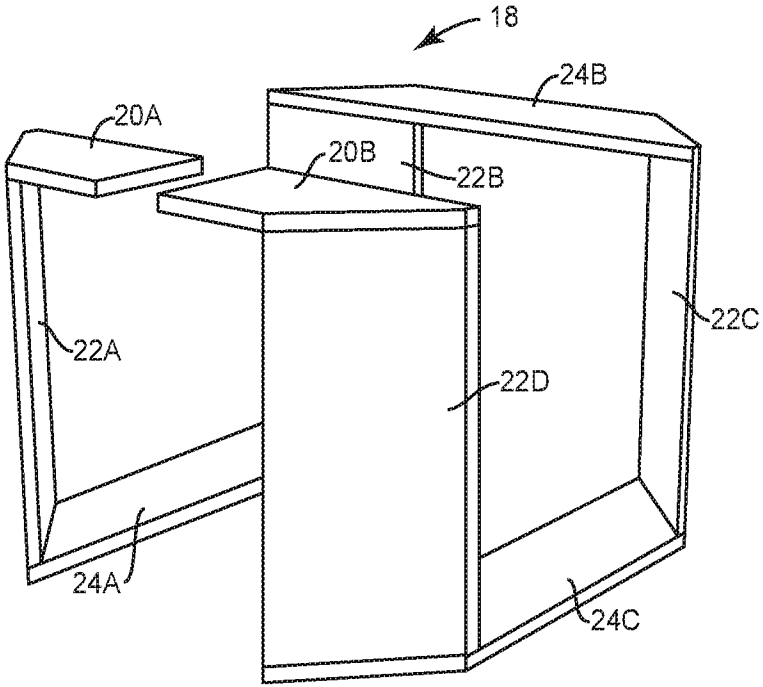

In an effort to improve both the performance and achievable coupling factors of conventional inductors, three-dimensional folded inductor structures have recently been introduced. FIGS. 2A and 2B show a three-dimensional folded inductor structure 18 according to one embodiment of the present disclosure. Specifically, FIG. 2A shows an isometric view of the three-dimensional folded inductor structure 18 while FIG. 2B shows a top view of the three-dimensional folded inductor structure 18. The three-dimensional folded inductor structure 18 includes a first terminal plate 20A, a first column 22A connecting the first terminal plate 20A to a first connector plate 24A, a second column 22B connecting the first connector plate 24A to a second connector plate 24B, a third column 22C connecting the second connector plate 24B to a third connector plate 24C, and a fourth column 22D connecting the third connector plate 24C to a second terminal plate 20B.

The first terminal plate 20A, the second terminal plate 20B, and the second connector plate 24B are located in a first plane. The first connector plate 24A and the third connector plate 24C are located in a second plane, which is parallel to the first plane. The first column 22A, the second column 22B, the third column 22C, and the fourth column 22D (referred to collectively as the columns 22) are perpendicular to both the first plane and the second plane and run between them. In some embodiments, the three-dimensional folded inductor structure 18 is symmetrical about a third plane, which is perpendicular to the first plane and the second plane. Further details of the three-dimensional folded inductor structure 18 are discussed in U.S. patent application Ser. Nos. 14/450,156 now issued as U.S. Pat. No. 9,899,133, 14/931,689, now issued as U.S. Pat. No. 9,929,458, 14/931,165 now issued as U.S. Pat. No. 9,698,751, and 14/931,720 now issued as U.S. Pat. No. 10,062,629, the contents of which are hereby incorporated by reference in their entireties.

While not shown to avoid obscuring the drawings, the various parts of the three-dimensional folded inductor structure 18 are supported by an insulating substrate, such as a laminate, a semiconductor substrate, or the like. The first terminal plate 20A and the second terminal plate 20B (referred to collectively as the terminal plates 20), along with the first connector plate 24A, the second connector plate 24B, and the third connector plate 24C (referred to collectively as the connector plates 24) may be provided on different layers of the insulating substrate by well-known metallization processes (e.g., sputtering and lithography). The columns 22 may be provided through different layers of the insulating substrate by well-known via formation processes. In some embodiments, the columns 22 are provided as elongated via columns with a low resistivity, however, the columns 22 may be provided by any number of vias having any shape or size without departing from the principles of the present disclosure.

The three-dimensional folded inductor structure 18 provides an inductance between the first terminal plate 20A and the second terminal plate 20B. Due to the orientation of the terminal plates 20, the columns 22, and the connector plates 24, the magnetic field generated by the three-dimensional folded inductor structure 18 when a current is provided between the first terminal plate 20A and the second terminal plate 20B is substantially confined to an interior of the structure. This is due to the opposing currents and thus magnetic fields generated by parallel elements of the three-dimensional folded inductor structure 18 such as parallel ones of the columns 22 and parallel ones of the connector plates 24, which are destructive outside the boundaries of the three-dimensional folded inductor structure 18 and constructive within the boundaries of the three-dimensional folded inductor structure 18. Accordingly, the three-dimensional folded inductor structure 18 may provide a very low or zero coupling factor with other inductor structures that are adjacent thereto.

A width $W_C$ of the columns 22 may be increased to adjust both the coupling factor of the three-dimensional folded inductor structure 18 and the quality factor thereof. Increasing the width $W_C$ of the columns 22 in turn increases the metal density of the three-dimensional folded inductor structure 18 without increasing an inductive resistance thereof. However, the width $W_C$ of the columns 22 is limited by a required separation between them, which is around 150 microns. A length $L_C$ of the connector plates 24 is dependent on the width $W_C$ of the columns 22 and the size of the spacing therebetween. By adjusting the width $W_C$ of the columns 22 and the length $L_C$ of the connector plates, a desired quality factor for the three-dimensional folded inductor structure 18 can be achieved.

In some embodiments, the width $W_C$ of the columns 22, the length $L_C$ of the connector plates 24, and the angles at which the columns 22 and thus the edges of the connector plates 24 are provided are chosen such that a uniform current path exists between the terminal plates 20. That is, the three-dimensional folded inductor structure 18 is provided so that current crowding does not occur between the terminal plates 20, the columns 22, and the connector plates 24. In one embodiment, straightening out the three-dimensional folded inductor structure 18 into a planar structure results in a continuous metal strip having equal height $H_C$ as illustrated in FIG. 3.

Figure 3:
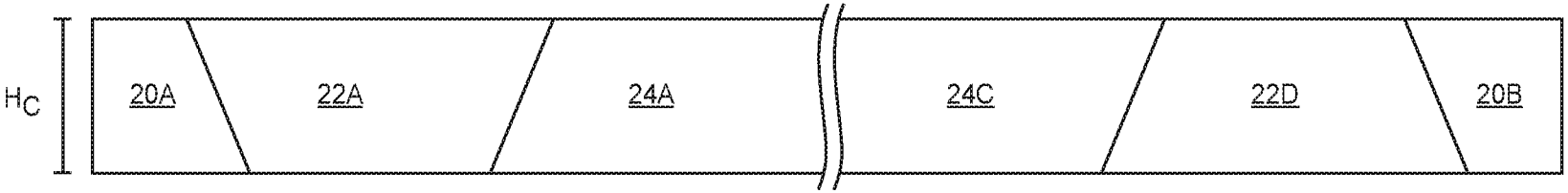
FIG. 3 illustrates an unfolded three-dimensional folded inductor structure according to one embodiment of the present disclosure.
Figure 4:
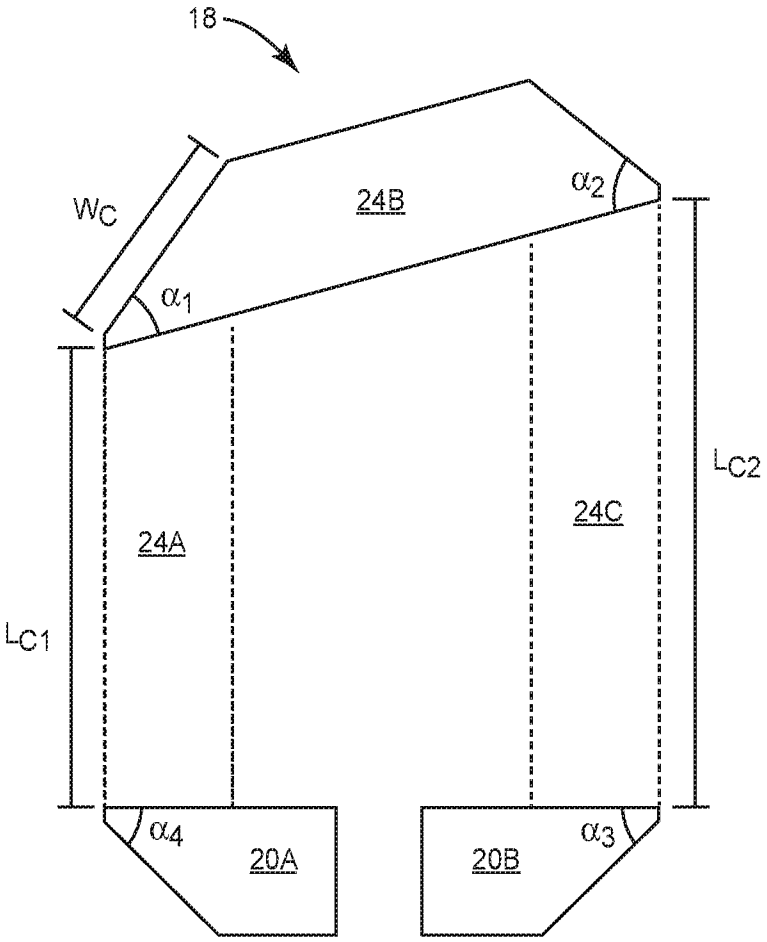
FIG. 4 illustrates a three-dimensional folded inductor structure according to one embodiment of the present disclosure.

Notably, the three-dimensional folded inductor structure 18 shown in FIGS. 2 and 3 is merely exemplary. The shape and size of the three-dimensional folded inductor structure 18 may be provided in many different ways, all of which are contemplated herein. For example, the three-dimensional folded inductor structure 18 may be provided in a polygonal shape wherein the angle at which the columns 22 and thus the edges of the connector plates 24 are asymmetrical (i.e., not 45° as shown above). FIG. 4 shows a top-view of a three-dimensional folded inductor structure 18 according to one such embodiment. To provide the desired cancellation, the angles at which the columns 22 and thus the edges of the connector plates 24 are provided, as well as the width $W_C$ of the columns 22 and the length $L_C$ of the connector plates 24 must satisfy Equation (1):

$$\Sigma\alpha_i=(L_{C1}-L_{C2})\times 90° \quad (1)$$

Accordingly, the three-dimensional folded inductor structure 18 may be provided in any number of polygonal forms. The three-dimensional folded inductor structure 18 may also be provided in other shapes, such as a sphere, a pyramid, and the like, some examples of which are detailed in U.S. patent application Ser. No. 14/450,156, now issued as U.S. Pat. No. 9,899,133, the disclosure of which is incorporated in its entirety above. The principles discussed herein apply equally to any of these three-dimensional folded inductor structures 18.

Figure 5A:
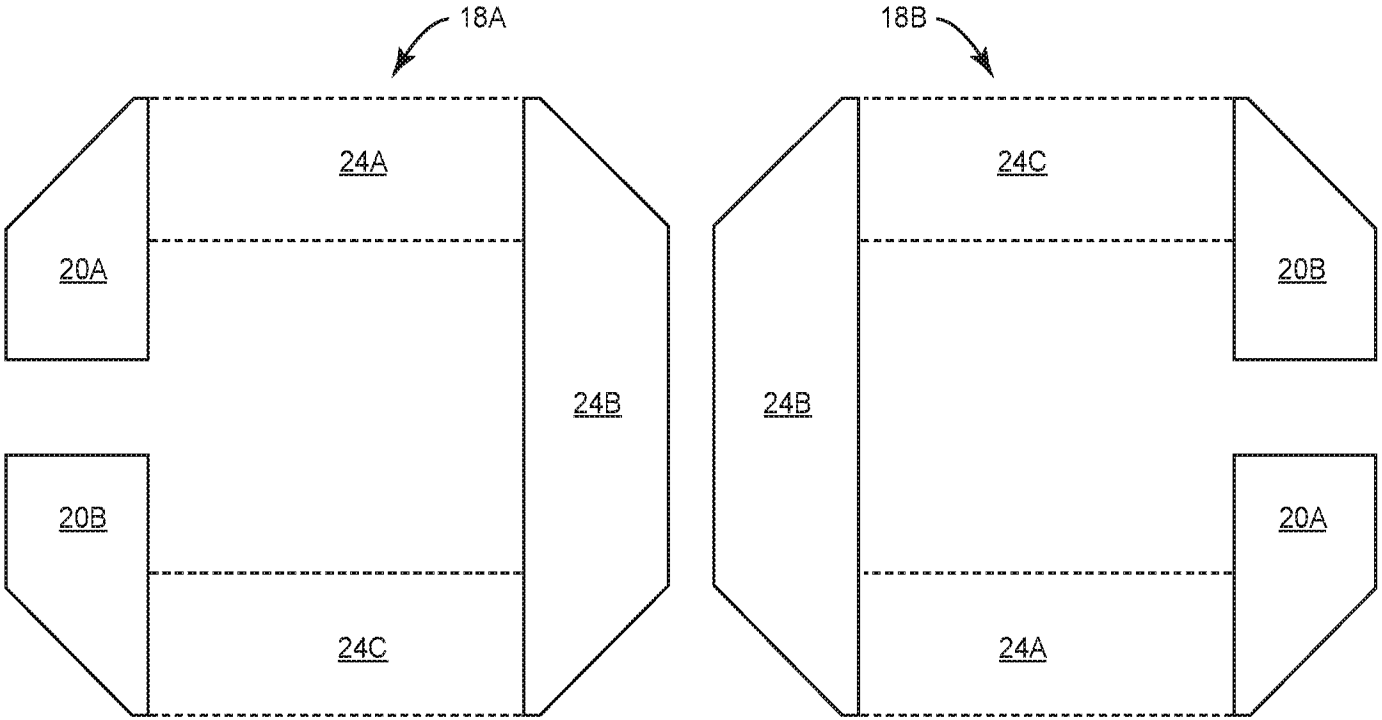
FIGS. 5A and 5B illustrate a coupled inductor structure according to various embodiments of the present disclosure.
Figure 5B:
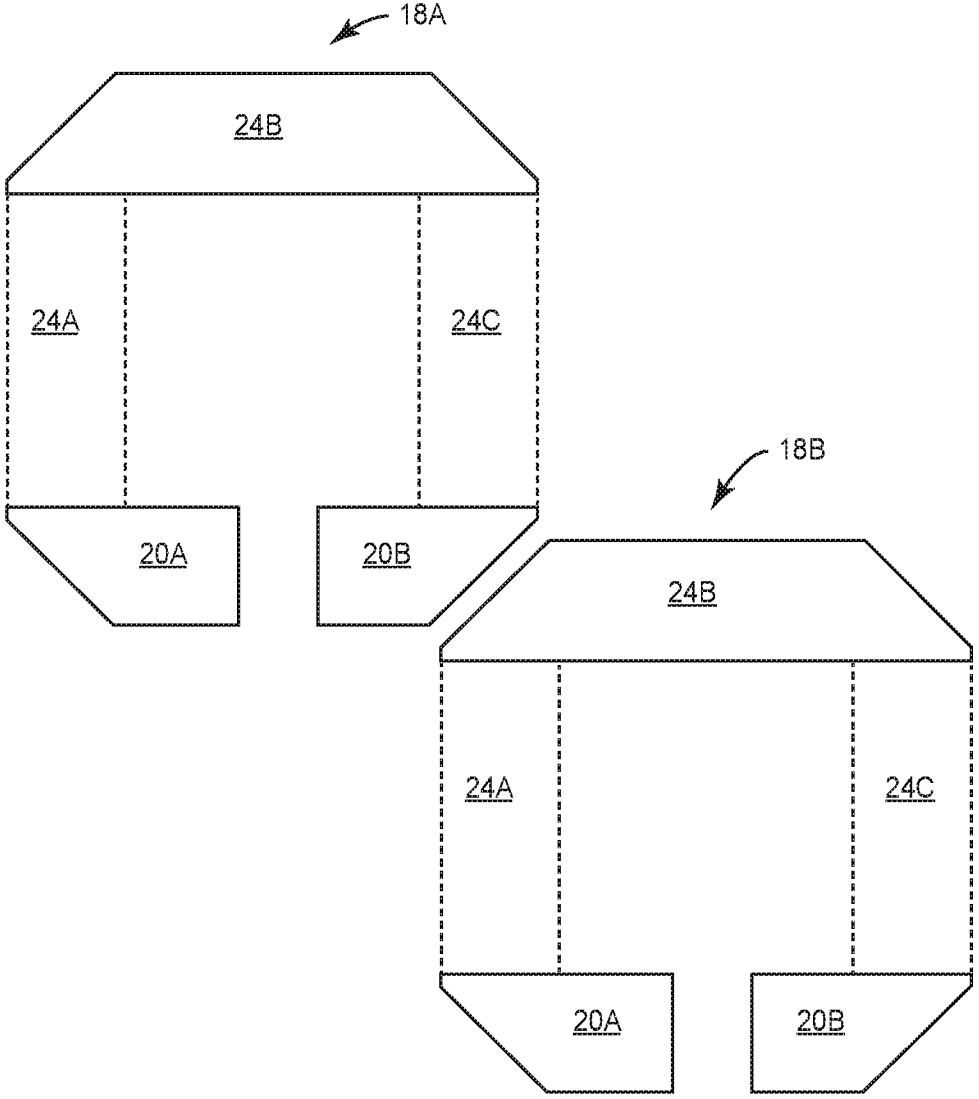

As discussed above, it may be desirable to provide different levels of coupling between inductors in different situations. For example, in the conventional diplexer 10 discussed above it may be desirable to provide a first level of coupling between the first resonator inductor $L_{R1}$ and the second resonator inductor $L_{R2}$ and provide a second level of coupling between the first resonator inductor $L_{R1}$ and the third resonator inductor $L_{R3}$. As discussed above, the magnetic field generated by the three-dimensional folded inductor structure 18 is confined substantially to the interior thereof. Therefore, only a small amount of coupling can be achieved when different three-dimensional folded inductor structures 18 are provided adjacent to one another as shown in FIGS. 5A and 5B. FIG. 5A shows a top view of a first three-dimensional folded inductor structure 18A and a second three-dimensional folded inductor structure 18B adjacent to one another such that a "mouth" of the first three-dimensional folded inductor structure 18A, which is the side of the first three-dimensional folded inductor structure 18A adjacent to the second connector plate 24B thereof, is facing a "mouth" of the second three-dimensional folded inductor structure 18B (also the side of the second three-dimensional folded inductor structure 18B adjacent to the second connector plate 24B thereof). Referred to as "mouth" coupling (where none of the columns 22 are parallel to one another as shown), such a configuration provides low coupling (i.e., a coupling factor less than 0.1) between the first three-dimensional folded inductor structure 18A and the second three-dimensional folded inductor structure 18B. FIG. 5B shows a top view of the same first three-dimensional folded inductor structure 18A and second three-dimensional folded inductor structure 18B adjacent to one another such that a column 22 (not shown) of the first three-dimensional folded inductor structure 18A is facing a column 22 (not shown) of the second three-dimensional folded inductor structure 18B. Referred to as "sidewall" coupling, such a configuration also provides low coupling (i.e., a coupling factor less than 0.1) between the first three-dimensional folded inductor structure 18A and the second three-dimensional folded inductor structure 18B. Several other configurations are possible for arranging the three-dimensional folded inductor structures with respect to one another to provide relatively low coupling. The low coupling factor between the three-dimensional folded inductor structures is due to the confined magnetic fields thereof discussed above. In each of FIGS. 5A and 5B, a total volume of the first three-dimensional folded inductor structure 18A and the second three-dimensional folded inductor structure 18B may be less than 0.5 $mm^3$, which is significantly smaller than that achievable by conventional inductor structures having these small coupling factors. In various embodiments, a cross-sectional area of the first three-dimensional inductor structure 18A and the second three-dimensional inductor structure 18B may be less than 1 $mm^2$ and a volume may be less than 0.125 $mm^3$. Specifically, each one of the inductors may have dimensions between 600×800×400 microns to 1000×800×300 microns. Further, the first three-dimensional folded inductor structure 18A and the second three-dimensional folded inductor structure 18B may each have a quality factor greater than 70, and typically greater than 120 at a frequency of 2 GHz, which is significantly higher than the quality factors achievable by comparably sized conventional inductor structures.

Figure 6B:
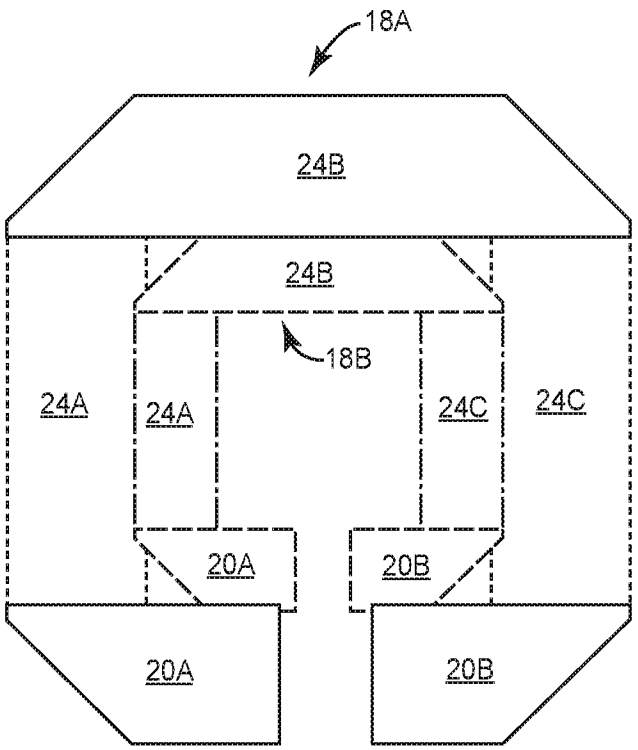
FIGS. 6A and 6B illustrate a coupled inductor structure according to one embodiment of the present disclosure.
Figure 6A:
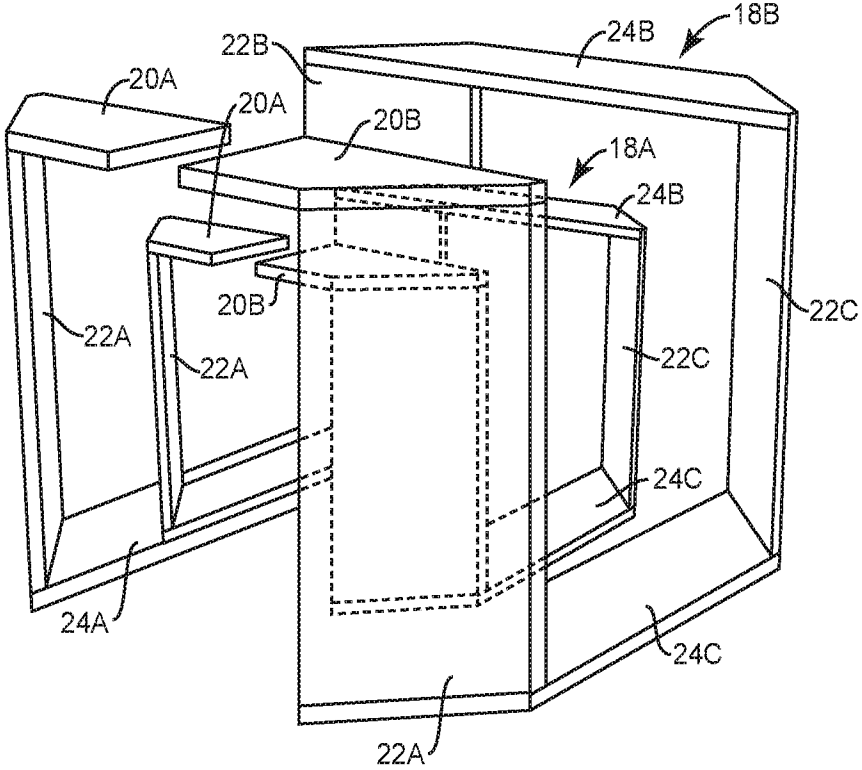

To provide a higher level of coupling between two three-dimensional folded inductor structures, one three-dimensional folded inductor structure may be nested within the other as shown in FIG. 6. As shown, the first three-dimensional folded inductor structure 18A is nested within the second three-dimensional folded inductor structure 18B such that the entirety of the first three-dimensional folded inductor structure 18A is within the second three-dimensional folded inductor structure 18B. Since the magnetic field of the second three-dimensional folded inductor structure 18B is substantially confined to the interior thereof, coupling between the first three-dimensional folded inductor structure 18A and the second three-dimensional folded inductor structure 18B is much higher than that discussed above with respect to FIGS. 5A and 5B. In some embodiments, a coupling factor between the first three-dimensional folded inductor structure 18A and the second three-dimensional folded inductor structure 18B is between 0.1 and 0.4, depending on the size, orientation, and overlap between the first three-dimensional folded inductor structure 18A and the second three-dimensional folded inductor structure 18B. When nested within the second three-dimensional folded inductor structure 18B, the first three-dimensional folded inductor structure 18A and the second three-dimensional folded inductor structure 18B are coupled in a variety of ways, such as by "mouth" coupling and "sidewall" coupling as discussed above, but also by "broadside" coupling, wherein different ones of the connector plates 24 are parallel to one another in different planes. The amount of coupling and thus the coupling factor between the first three-dimensional folded inductor structure 18A and the second three-dimensional folded inductor structure 18B may be adjusted by changing the dimensions of the first three-dimensional folded inductor structure 18A and the second three-dimensional folded inductor structure 18B with respect to one another and/or changing the shape, position, and orientation of the first three-dimensional folded inductor structure 18A within the confines of the second three-dimensional folded inductor structure 18B. In one embodiment, the total volume of the first three-dimensional folded inductor structure 18A and the second three-dimensional folded inductor structure 18B is less than 0.5 $mm^3$, which is significantly smaller than that achievable by conventional inductor structures having these moderate coupling factors. Further, the first three-dimensional folded inductor structure 18A and the second three-dimensional folded inductor structure 18B may each have a quality factor greater than 70, and typically greater than 120 at a frequency of 2 GHz, which is significantly higher than the quality factors achievable by comparably sized conventional inductor structures.

Figure 7:
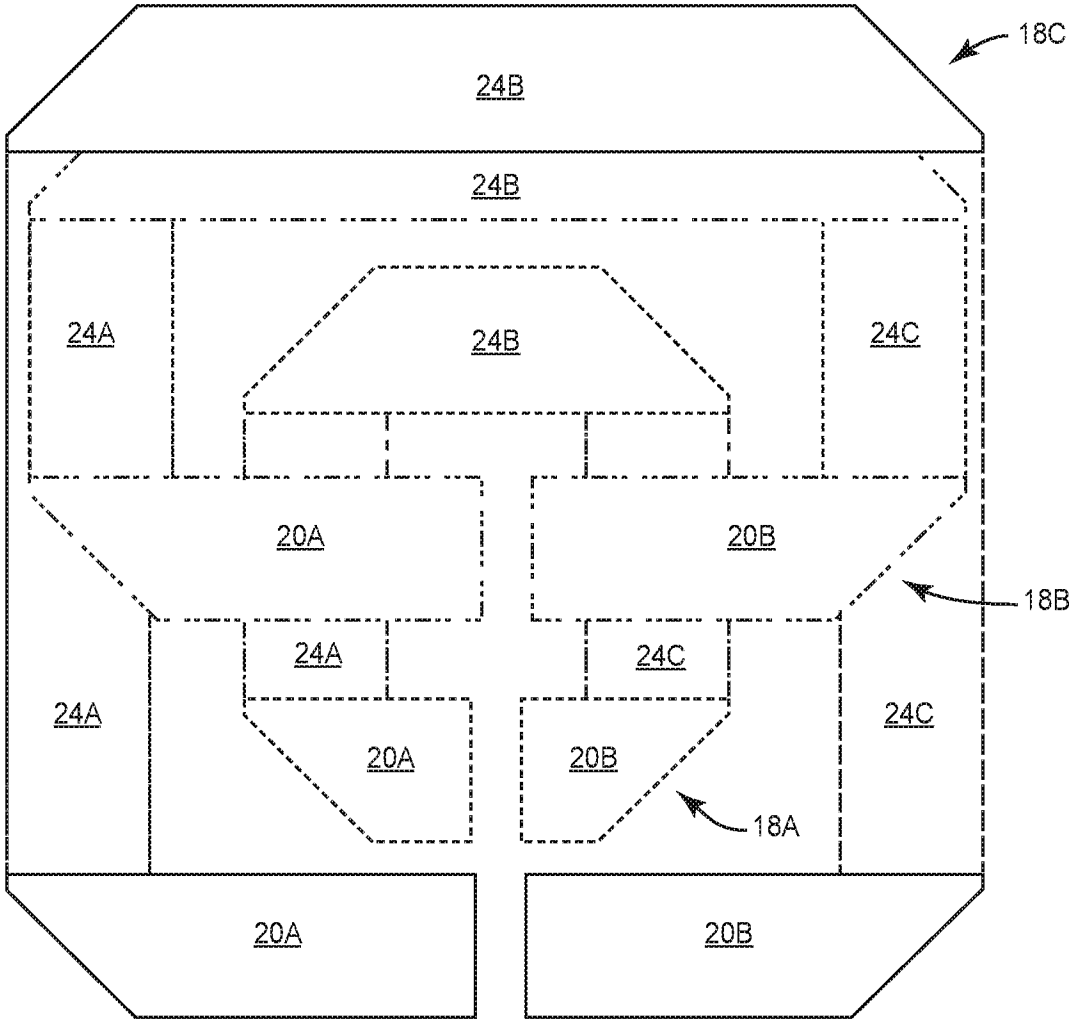
FIG. 7 illustrates a coupled inductor structure according to one embodiment of the present disclosure.

In some embodiments, three or more three-dimensional folded inductor structures 18 may be nested within one another as shown in FIG. 7, which is a top view of a first three-dimensional folded inductor structure 18A nested within a second three-dimensional folded inductor structure 18B, which is in turn nested in a third three-dimensional folded inductor structure 18C as shown. Additional three-dimensional folded inductor structures 18 may be added as desired. The coupling factors between the three-dimensional folded inductor structures 18 may be adjusted as desired by changing the shape, orientation, and position of each one of the three-dimensional folded inductor structures 18 with respect to one another. In such an embodiment, a coupling factor between the first three-dimensional folded inductor structure 18A and the second three-dimensional folded inductor structure 18B may be between 0.1 and 0.4, a coupling factor between the second three-dimensional folded inductor structure 18B and the third three-dimensional folded inductor structure 18C may be between 0.1 and 0.4, and a coupling factor between the first three-dimensional folded inductor structure 18A and the third three-dimensional folded inductor structure 18C may be between 0.1 and 0.4. In one embodiment, the total volume of the first three-dimensional folded inductor structure 18A, the second three-dimensional folded inductor structure 18B, and the third three-dimensional folded inductor structure 18C is less than 0.5 $mm^3$, which is significantly smaller than that achievable by conventional inductor structures having these moderate coupling factors. Further, the first three-dimensional folded inductor structure 18A, the second three-dimensional folded inductor structure 18B, and the third three-dimensional folded inductor structure 18C may each have a quality factor greater than 70, and typically greater than 120 at a frequency of 2 GHz, which is significantly higher than the quality factors achievable by comparably sized conventional inductor structures.

Figure 8:
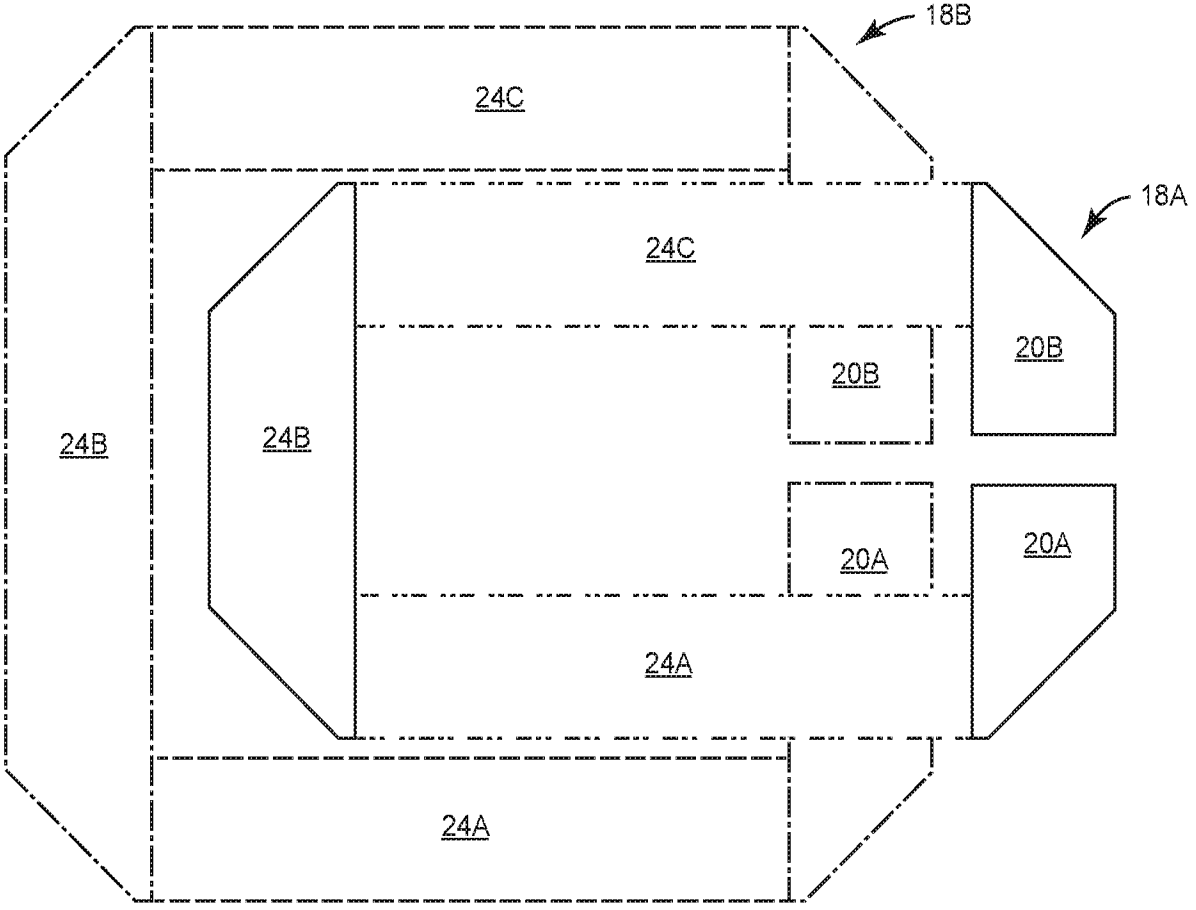
FIG. 8 illustrates a coupled inductor structure according to one embodiment of the present disclosure.
Figure 9:
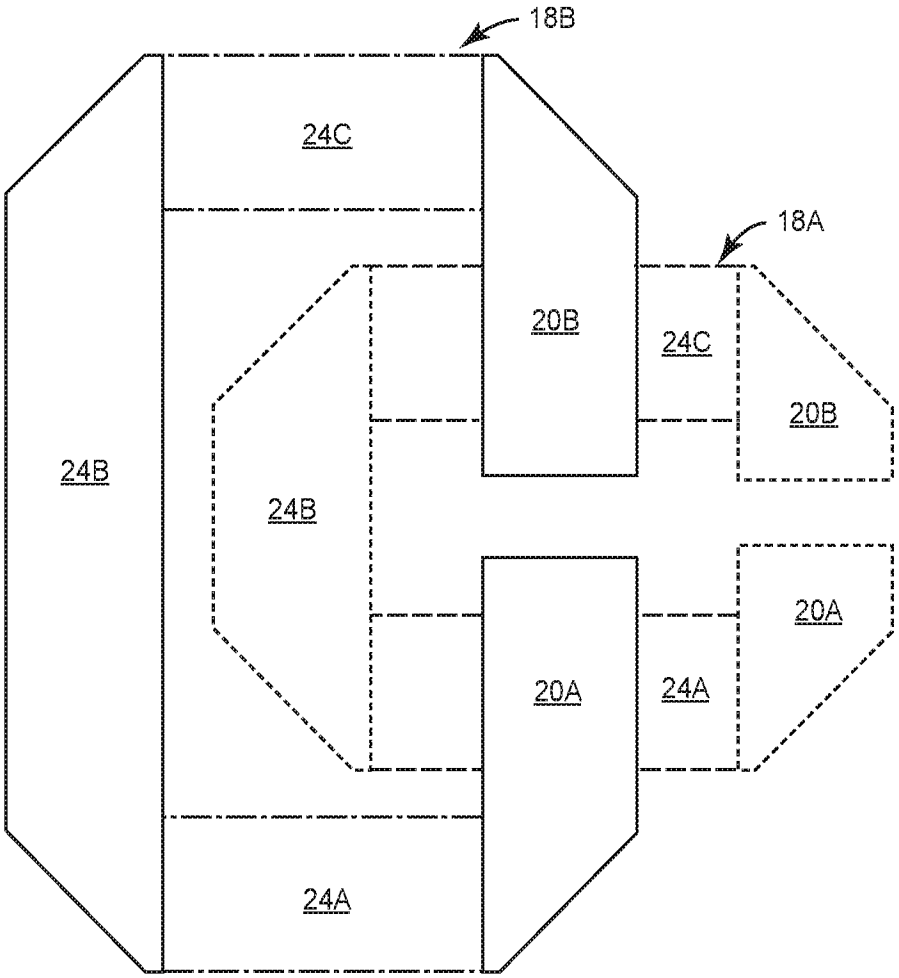
FIG. 9 illustrates a coupled inductor structure according to one embodiment of the present disclosure.

The coupling factors achieved by nesting two or more three-dimensional folded inductor structures may be moderate as discussed above. In situations in which a lower amount of coupling or no coupling is desired between nearby three-dimensional folded inductor structures, they may be arranged as shown in FIG. 8. As shown, a first three-dimensional folded inductor structure 18A is partially nested within a second three-dimensional folded inductor structure 18B such that a portion of the first three-dimensional folded inductor structure 18A is within the second three-dimensional folded inductor structure 18B and a portion of the first three-dimensional folded inductor structure 18A is outside of the second three-dimensional folded inductor structure 18B. In such a case, the portion of the first three-dimensional folded inductor structure 18A within the bounds of the second three-dimensional folded inductor structure 18B may provide a first coupling factor, while the portion of the first three-dimensional folded inductor structure 18A outside the bounds of the second three-dimensional folded inductor structure 18B may provide a second coupling factor. In certain situations, these coupling factors may be opposite one another and thus cancel each other out, either fully or partially. In one embodiment, the coupling factor between the first three-dimensional folded inductor structure 18A and the second three-dimensional folded inductor structure is between 0.1 and 0.4. To achieve a low coupling factor (i.e., near zero), the first three-dimensional folded inductor structure 18A may be arranged such that the second connector plate 24B thereof is centered within the second three-dimensional folded inductor structure 18B where a magnetic field generated by the second three-dimensional folded inductor structure 18B is minimal, as shown in FIG. 9. In one embodiment, the total volume of the first three-dimensional folded inductor structure 18A and the second three-dimensional folded inductor structure 18B is less than 0.5 $mm^3$, which is significantly smaller than that achievable by conventional inductor structures having these moderate coupling factors. Further, the first three-dimensional folded inductor structure 18A and the second three-dimensional folded inductor structure 18B may each have a quality factor greater than 70, and typically greater than 120 at a frequency of 2 GHz, which is significantly higher than the quality factors achievable by comparably sized conventional inductor structures.

Figure 10:
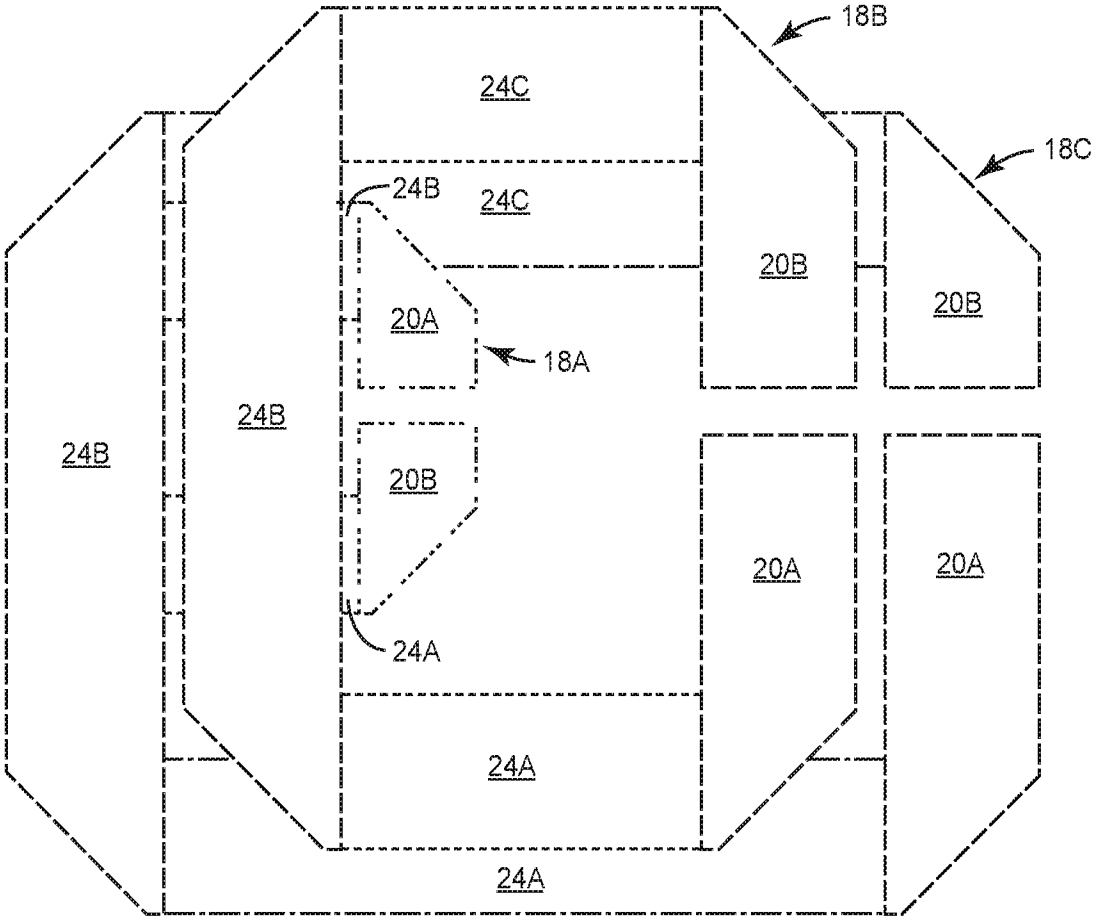
FIG. 10 illustrates a coupled inductor structure according to one embodiment of the present disclosure.

In some embodiments, three or more three-dimensional folded inductor structures may be nested both partially and fully, as illustrated in FIG. 10 in which a first three-dimensional folded inductor structure 18A is partially nested within a second three-dimensional folded inductor structure 18B and fully nested within a third three-dimensional folded inductor structure 18C and the second three-dimensional folded inductor structure 18B is partially nested within the third three-dimensional folded inductor structure 18C. As discussed above, the coupling factors between the first three-dimensional folded inductor structure 18A, the second three-dimensional folded inductor structure 18B, and the third three-dimensional folded inductor structure 18C may be adjusted by changing the shape, size, orientation, and position of each one of the three-dimensional folded inductor structures 18 with respect to one another. In one embodiment, the total volume of the first three-dimensional folded inductor structure 18A, the second three-dimensional folded inductor structure 18B, and the third three-dimensional folded inductor structure 18C is less than 0.5 $mm^3$, which is significantly smaller than that achievable by conventional inductor structures having these moderate coupling factors. Further, the first three-dimensional folded inductor structure 18A, the second three-dimensional folded inductor structure 18B, and the third three-dimensional folded inductor structure 18C may each have a quality factor greater than 70, and typically greater than 120 at a frequency of 2 GHz, which is significantly higher than the quality factors achievable by comparably sized conventional inductor structures.

While only three three-dimensional folded inductor structures are illustrated above, any number of three-dimensional folded inductor structures may be arranged in the configurations shown above (i.e., fully nested, partially nested, or adjacent to one another with various shapes, sizes, orientations, and positions with respect to one another) or any other configurations, which will be readily appreciated by those skilled in the art, to produce desired coupling factors therebetween. The unique inductor structures, which as discussed above significantly confine a magnetic field generated thereby to an interior of the structure, provide significantly more flexibility in generating a desired coupling factor, as they can be placed much closer together without achieving high coupling (e.g., coupling above 0.3) as occurs between conventional planar and "figure 8" inductors. By fully or partially nesting the three-dimensional folded inductor structures, moderate coupling, low coupling, and very low coupling can be achieved to produce a desired effect and improve filter performance as discussed above. Specifically, a combination of "mouth" coupling, "sidewall" coupling, and "broadside" coupling produce an overall desired coupling, and thus the amount of each of these couplings can be adjusted by changing the shape, size, orientation, and position of three-dimensional folded inductor structures with respect to one another to achieve a desired coupling factor. The coupled three-dimensional folded inductor structures may be provided in a lumped element filter such as a diplexer, a triplexer, or a multiplexer of any order. The coupling factors achievable by the three-dimensional folded inductor structures are not achievable by conventional inductor structures such as planar inductors and "figure 8" inductors without providing a great deal of space therebetween, which as discussed above is highly impractical. Providing the three-dimensional folded inductor structures as discussed herein allows for the achievement of moderate, low, and very low coupling factors while minimizing the space consumed by the structures. Accordingly, the performance of filtering circuitry incorporating the three-dimensional folded inductor structures may be significantly improved without adding to the size thereof.

Those skilled in the art will recognize improvements and modifications to the preferred embodiments of the present disclosure. All such improvements and modifications are considered within the scope of the concepts disclosed herein and the claims that follow.

What is claimed is:

1. A coupled inductor structure comprising:

a first three-dimensional folded inductor structure and a second three-dimensional folded inductor structure each comprising:

a first column, a second column, a third column, and a fourth column, each perpendicular to and running between a first plane and a second plane;

a first terminal plate in the first plane and coupled to the first column;

a second terminal plate in the first plane and coupled to the fourth column, wherein a gap is formed between the first terminal plate and the second terminal plate;

a first connector plate in the second plane such that the first connector plate runs between the first column and the second column;

a second connector plate in the first plane such that the second connector plate runs between the second column and the third column; and a third connector plate in the second plane such that the third connector plate runs between the third column and the fourth column;

wherein the first column, the second column, the third column, the fourth column, the first terminal plate, the second terminal plate, the first connector plate, the second connector plate, and the third connector plate form a loop shape laid over a three-dimensional volume, such that the loop shape extends out of the first terminal plate away from the gap and returns back to the second terminal plate towards the gap; and wherein at least a portion of the first three-dimensional folded inductor structure is located within a volume bounded by the second three-dimensional folded inductor structure.

2. The coupled inductor structure of claim 1 wherein a coupling factor between the first three-dimensional folded inductor structure and the second three-dimensional folded inductor structure is between 0.1 and 0.4.

3. The coupled inductor structure of claim 1 wherein the entirety of the first three-dimensional folded inductor structure is located within the volume bounded by the second three-dimensional folded inductor structure.

4. The coupled inductor structure of claim 3 wherein a coupling factor between the first three-dimensional folded inductor structure and the second three-dimensional folded inductor structure is between 0.1 and 0.4.

5. The coupled inductor structure of claim 1 wherein a first portion of the first three-dimensional folded inductor structure is located within the volume bounded by the second three-dimensional folded inductor structure and a second portion of the first three-dimensional folded inductor structure is located outside the volume bounded by the second three-dimensional folded inductor structure.

6. The coupled inductor structure of claim 5 wherein:

the first portion of the first three-dimensional folded inductor structure and the second three-dimensional folded inductor structure have a first coupling factor;

the second portion of the first three-dimensional folded inductor structure and the second three-dimensional folded inductor structure have a second coupling factor; and the first coupling factor and the second coupling factor have opposite signs.

7. The coupled inductor structure of claim 6 wherein a coupling factor between the first three-dimensional folded inductor structure and the second three-dimensional folded inductor structure is between 0.1 and 0.4.

8. The coupled inductor structure of claim 1 wherein the first three-dimensional folded inductor structure and the second three-dimensional folded inductor structure are symmetrical about a third plane, which is perpendicular to the first plane and the second plane.

9. The coupled inductor structure of claim 1 wherein a total volume of the coupled inductor structure is less than 0.5 $mm^3$.

10. The coupled inductor structure of claim 9 wherein a coupling factor between the first three-dimensional folded inductor structure and the second three-dimensional folded inductor structure is between 0.1 and 0.4.

11. The coupled inductor structure of claim 1 further comprising a third three-dimensional folded inductor structure comprising:

a first column, a second column, a third column, and a fourth column, each perpendicular to and running between a first plane and a second plane;

a first terminal plate in the first plane and coupled to the first column;

a second terminal plate in the first plane and coupled to the fourth column;

a first connector plate in the second plane such that the first connector plate runs between the first column and the second column;

a second connector plate in the first plane such that the second connector plate runs between the second column and the third column; and a third connector plate in the second plane such that the third connector plate runs between the third column and the fourth column;

wherein at least a portion of the second three-dimensional folded inductor structure is located within a volume bounded by the third three-dimensional folded inductor structure.

12. The coupled inductor structure of claim 11 wherein:

a coupling factor between the first three-dimensional folded inductor structure and the second three-dimensional folded inductor structure is between 0.1 and 0.4;

a coupling factor between the second three-dimensional folded inductor structure and the third three-dimensional folded inductor structure is between 0.1 and 0.4; and a coupling factor between the first three-dimensional folded inductor structure and the third three-dimensional folded inductor structure is between 0.1 and 0.4.

13. The coupled inductor structure of claim 11 wherein:

the entirety of the second three-dimensional folded inductor structure is located within the volume bounded by the third three-dimensional folded inductor structure; and the entirety of the first three-dimensional folded inductor structure is located within the volume bounded by the second three-dimensional folded inductor structure.

14. The coupled inductor structure of claim 11 wherein:

the entirety of the second three-dimensional folded inductor structure is located within the volume bounded by the third three-dimensional folded inductor structure; and a first portion of the first three-dimensional folded inductor structure is located within the volume bounded by the second three-dimensional folded inductor structure and a second portion of the first three-dimensional folded inductor structure is located outside the volume bounded by the second three-dimensional folded inductor structure.

15. The coupled inductor structure of claim 11 wherein:

a first portion of the second three-dimensional folded inductor structure is located within the volume bounded by the third three-dimensional folded inductor structure and a second portion of the second three-dimensional folded inductor structure is located outside the volume bounded by the third three-dimensional folded inductor structure; and the entirety of the first inductor structure is located within the volume bounded by the second three-dimensional folded inductor structure.

16. The coupled inductor structure of claim 11 wherein:

a first portion of the second three-dimensional folded inductor structure is located within the volume bounded by the third three-dimensional folded inductor structure and a second portion of the second three-dimensional folded inductor structure is located outside the volume bounded by the third three-dimensional folded inductor structure; and a first portion of the first three-dimensional folded inductor structure is located within the volume bounded by the second three-dimensional folded inductor structure and a second portion of the first three-dimensional folded inductor structure is located outside the volume bounded by the second three-dimensional folded inductor structure.

17. The coupled inductor structure of claim 11 wherein a total volume of the coupled inductor structure is less than 0.5 $mm^3$.

18. The coupled inductor structure of claim 17 wherein:

a coupling factor between the first three-dimensional folded inductor structure and the second three-dimensional folded inductor structure is between 0.1 and 0.4;

a coupling factor between the second three-dimensional folded inductor structure and the third three-dimensional folded inductor structure is between 0.1 and 0.4; and a coupling factor between the first three-dimensional folded inductor structure and the third three-dimensional folded inductor structure is between 0.1 and 0.4.

19. The coupled inductor structure of claim 11 wherein the first three-dimensional folded inductor structure, the second three-dimensional folded inductor structure, and the third three-dimensional folded inductor structure are symmetrical about a third plane, which is perpendicular to the first plane and the second plane.

20. A coupled inductor structure comprising a plurality of three-dimensional folded inductor structures, wherein:

each of the plurality of three-dimensional folded inductor structures comprises a first terminal plate, a second terminal plate, and a gap in between;

each of the plurality of three-dimensional folded inductor has a loop shape laid over a three-dimensional volume, such that the loop shape extends out of the first terminal plate away from the gap and returns back to the second terminal plate towards the gap; and a coupling factor between a first pair of the plurality of three-dimensional folded inductor structures is less than 0.05, a coupling factor between a second pair of the plurality of three-dimensional folded inductor structures is greater than 0.3, and a total volume of the coupled inductor structure is less than 0.5 $mm^3$.

21. The coupled inductor structure of claim 20 wherein at least a portion of at least one of the plurality of three-dimensional folded inductor structures is located within a volume bounded by another one of the plurality of three-dimensional folded inductor structures.

* * * * *